US006004888A

United States Patent [19]

Sugimoto et al.

[11] Patent Number: 6,004,888

[45] Date of Patent: Dec. 21, 1999

[54] FIBROUS SHEET FOR STRUCTURE REINFORCEMENT AND STRUCTURE REINFORCED WITH SAME

[75] Inventors: Morihiko Sugimoto; Takeshi Honjou, both of Ibaraki, Japan

[73] Assignee: Teijin Limited, Osaka, Japan

[21] Appl. No.: 09/029,498

[22] PCT Filed: Jul. 3, 1997

[86] PCT No.: PCT/JP97/02314

§ 371 Date: Feb. 26, 1998

§ 102(e) Date: Feb. 26, 1998

[87] PCT Pub. No.: WO98/02606

PCT Pub. Date: Jan. 22, 1998

[30] Foreign Application Priority Data

Jul. 16, 1996 [JP] Japan ..... 8-185899
Sep. 25, 1996 [JP] Japan ..... 8-252907

[51] Int. Cl.[6] ..... D04B 21/14

[52] U.S. Cl. ..... 442/60; 442/192; 442/203; 442/205; 442/208; 139/1; 139/383

[58] Field of Search ..... 139/1, 383; 442/60, 442/192, 203, 205, 208

[56] References Cited

FOREIGN PATENT DOCUMENTS 2 568 275 1/1986 France ..... D03D 11/00
2032423 1/1971 Germany ..... B29D 3/02
92 00 764 5/1992 Germany ..... A47H 13/12
57-52221 11/1982 Japan .
5-332031 12/1993 Japan .
7-243149 9/1995 Japan ..... D03D 1/00
8-23096 3/1996 Japan .
A-2032476 5/1980 United Kingdom .

OTHER PUBLICATIONS

Emery, The Primary Structure of Fabrics, The Textile Museum, pp. 74–75, 1966.

Lehner: "Die Chancen der Kettenwirkerei im Wachstumsmarkt der technischen Textilien", Melliand Textilberichte, vol. 70, No. 6, Jun. 1989, Heidelberg, pp. 428–432, XP000073155.

*Primary Examiner*—R C Weisberger
*Attorney, Agent, or Firm*—Sughrue, Mion, Zinn, Macpeak & Seas, PLLC

[57] ABSTRACT

A fibrous sheet for structure reinforcement comprising a sheet layer of reinforcing continuous filament bundles (1) arranged parallelly spaced out from each other, auxiliary covering yarns (3, 4) arranged on both sides of the sheet layer in such a manner that each of the covering yarns intersects respective reinforcing filament bundles (1) while meandering along the longitudinal direction of the reinforcing filament bundles on at least one side of the sheet layer and auxiliary chain-stitching yarns (6) which interconnects the auxiliary covering yarns on one side of the sheet layer with the auxiliary covering yarns on the other side of the sheet layer through individual spaces among adjacent reinforcing filament bundles in a warp knitting structure.

14 Claims, 3 Drawing Sheets

FIBROUS SHEET FOR STRUCTURE REINFORCEMENT AND STRUCTURE REINFORCED WITH SAME

TECHNICAL FIELD

The present invention relates to a fibrous sheet for structure reinforcement and a structure reinforced with the same. The present invention relates in more detail to a fibrous sheet for structure reinforcement most suitable for reinforcing not only general structures but also piers and floor systems of elevated structures, columns and walls of buildings, and the like, and a structure reinforced with the sheet.

BACKGROUND ART

Social problems have recently arisen from the brittleness and durability of cement structures, for example, destruction of bridges caused by earthquakes, rust formation on reinforcing bars caused by the neutralization of concrete, the fatigue of reinforcing steels caused by a sharp increase in traffic volumes, and the like. Replacing the structures with new ones is naturally satisfactory. However, replacing them is very costly.

When a pier of an elevated structure is taken as an example, a method for reinforcing the pier by bonding a steel sheet to the column containing concrete with an adhesive and a method for reinforcing it by bonding sheet-like reinforcing layers containing carbon fibers have been employed as countermeasures. In particular, the latter method has come to be adopted recently because the reinforced structures show significant reinforced effects and excellent durability, and because the reinforcing operation is simple. In the sheet-like reinforcing layers containing carbon fibers mentioned above, a number of carbon fibers are arranged in parallel in one or two directions. For example, Japanese Patent Kokai Publication Nos. 5-332031 and 7-243149 propose fibrous sheets for structure reinforcement in which carbon fibers are arranged in one direction. According to the former patent publication, carbon fiber bundles each containing a number of collected carbon fibers are arranged on an auxiliary sheet in one direction through an adhesive layer. According to the latter patent publication, carbon fibers are unidirectionally pulled mutually in parallel and in a sheet-like manner to form a sheet surface, and a weave structure is formed with transverse direction secondary fiber bundles and longitudinal direction secondary fiber bundles parallel to the carbon fibers, both types of the bundles being situated on respective sides of the sheet, to hold the sheet-like carbon fiber bundle arranged in one direction.

Furthermore, Japanese Patent Kokoku Publication Nos. 57-52221 and 8-23096 propose fibrous sheets for structure reinforcement in which carbon fibers are bidirectionally arranged.

According to the former patent publication, two carbon fiber bundles the carbon fibers of which are pulled unidirectionally and mutually in parallel in a sheet-like manner within each bundle and which face each other form a bidirectional sheet surface. The sheet surface is made to form a weave structure by longitudinal secondary fibers and transverse secondary fibers which are parallel to the respective fiber bundles, and is integrally held. According to the latter patent publication, a bias fabric is formed by a longitudinal carbon fiber bundle and a transverse carbon fiber bundle extending obliquely in relation to the longitudinal carbon fiber bundle, and the carbon fibers are bidirectionally arranged on the bias.

These unidirectional or bidirectional fibrous sheets for structure reinforcement are prepared to display the excellent high strength and high elastic modulus of the carbon fibers in the fiber axial direction as much as possible. Moreover, an auxiliary sheet and secondary fibers other than the carbon fibers are used to integrally hold the carbon fibers and obtain a fibrous sheet for structure reinforcement having a decreased fiber slippage within a sheet. That is, though a woven fabric is generally prepared by mutually intersecting warps and wefts to have a decreased fiber slippage, the constituent fibers are markedly bent at the intersectioning points of the warps and wefts. As a result, when a stress is applied to the fabric, the stress is concentrated at the bent portions, and in a woven fabric consisting of carbon fibers, the inherent high strength and high elastic modulus of carbon fibers cannot be displayed.

However, in spite of the improvement of the fibrous sheet for structure reinforcement as described above, a coarse fibrous sheet for structure reinforcement having a decreased fiber slippage, a high toughness unidirectionally or bidirectionally and numerous spaces among reinforcing fibers in a sheet is not obtained currently. To reinforce, for example, a column containing concrete by the use of the fibrous sheets for structure reinforcement, the concrete to be reinforced is first coated with an adhesive and the concrete is subsequently wound with the fibrous sheet while the sheet is being pressed, followed by coating the fibrous sheet with an adhesive to form a reinforcing layer. In order to make the fibrous sheet for structure reinforcement function as a reinforcement layer, it is important that the adhesive should penetrate sufficiently among fibers within each of the fiber bundles and among the fiber bundles. To meet the requirement, the fibrous sheet for structure reinforcement must have spaces the adhesive can penetrate among the reinforcing fibers forming the fibrous sheet, namely among fibers within each of the fiber bundles and among the fiber bundles. In general, when the spaces among the fibers in the fibrous sheet for structure reinforcement become large, there arise problems that the slippages among fibers become large and that the toughness falls in the arrangement direction of the fibers. Accordingly, the fibrous sheet for structure reinforcement can fulfill its role as a reinforcing layer of a member to be reinforced only after the fibrous sheet sufficiently meets the three requirements mentioned above.

Disclosure of Invention

An object of the present invention is to solve the problems associated with the prior art as mentioned above, and provide a fibrous sheet for structure reinforcement which has a decreased slippage within the sheet, a high toughness in the arranged directions of the fibers (one or two directions), numerous spaces among fibers and good penetration of an adhesive, as a fibrous sheet for reinforcing not only general structures but also piers of elevated structures, columns and walls of buildings, and the like, which also facilitates handling during execution of works and which has lightness of the reinforcing layer, and a structure reinforced with the sheet.

The present inventors have intensively conducted investigation to meet the following requirements simultaneously so that the above object is achieved: prevention of fiber slippage within the fibrous sheet for reinforcement, high toughness in the arranged direction of the fibers, and numerous spaces among fibers. As a result, they have elucidated that the problems can be solved only after adopting a specific warp knitting structure.

That is, according to the present invention, the following fibrous sheet for structure reinforcement is provided.

A fibrous sheet for structure reinforcement comprising a sheet layer of reinforcing continuous filament bundles arranged parallelly spaced out from each other, auxiliary covering yarns arranged on both sides of said sheet layer in such a manner that each of said covering yarns intersects respective reinforcing filament bundles while meandering along the longitudinal direction of said reinforcing filament bundles on at least one side of said sheet layer, and auxiliary chain-stitching yarns which interconnects the auxiliary covering yarns on one side of said sheet layer with the auxiliary covering yarns on the other side of said sheet layer through individual spaces among adjacent reinforcing filament bundles in a warp knitting structure.

Furthermore, according to the present invention, the following structure is provided.

A structure formed by covering a structure member to be reinforced with the fibrous sheet for structure reinforcement as mentioned above in the peripheral and/or longitudinal direction through an adhesive.

BRIEF DESCRIPTION OF DRAWINGS

FIG. 1(A) and FIG. 1(B) show the front side and the back side of the sheet, respectively.

FIG. 2(A) and FIG. 2(B) show the front side and the back side of the sheet, respectively.

FIG. 3(A) and FIG. 3(B) show the front side and the back side of the sheet, respectively.

BEST MODE FOR CARRYING OUT THE INVENTION

Figure 1A:
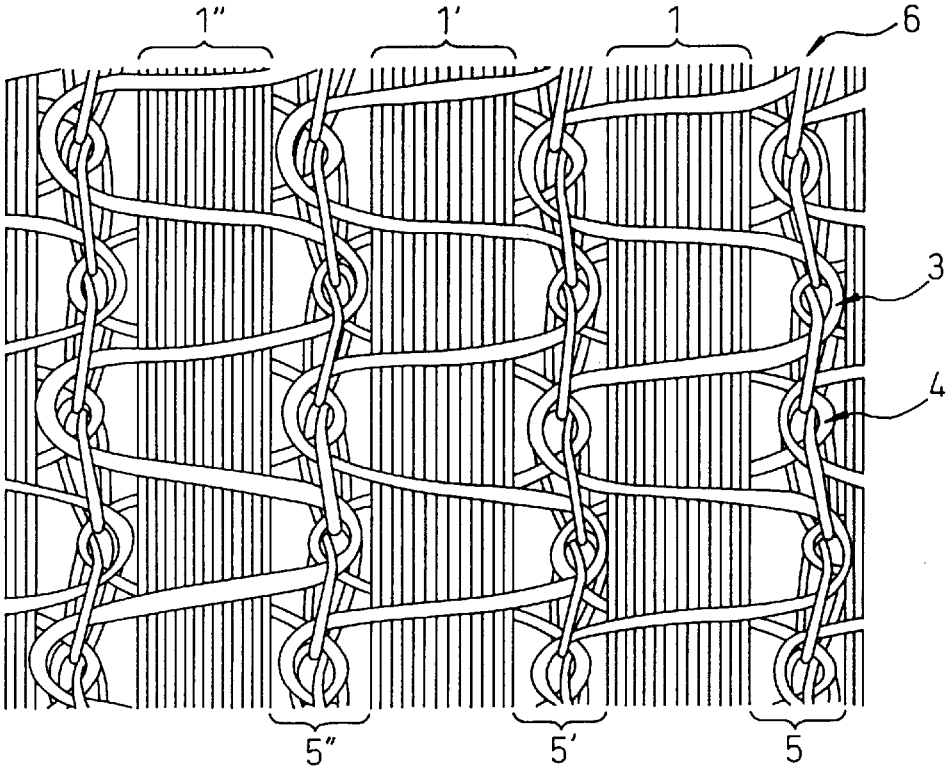
FIGS. 1(A) and 1(B) are enlarged fragmentary schematic views showing an example of a fibrous sheet for structure reinforcement of the present invention in which reinforcing continuous filaments are unidirectionally arranged.
Figure 1B:
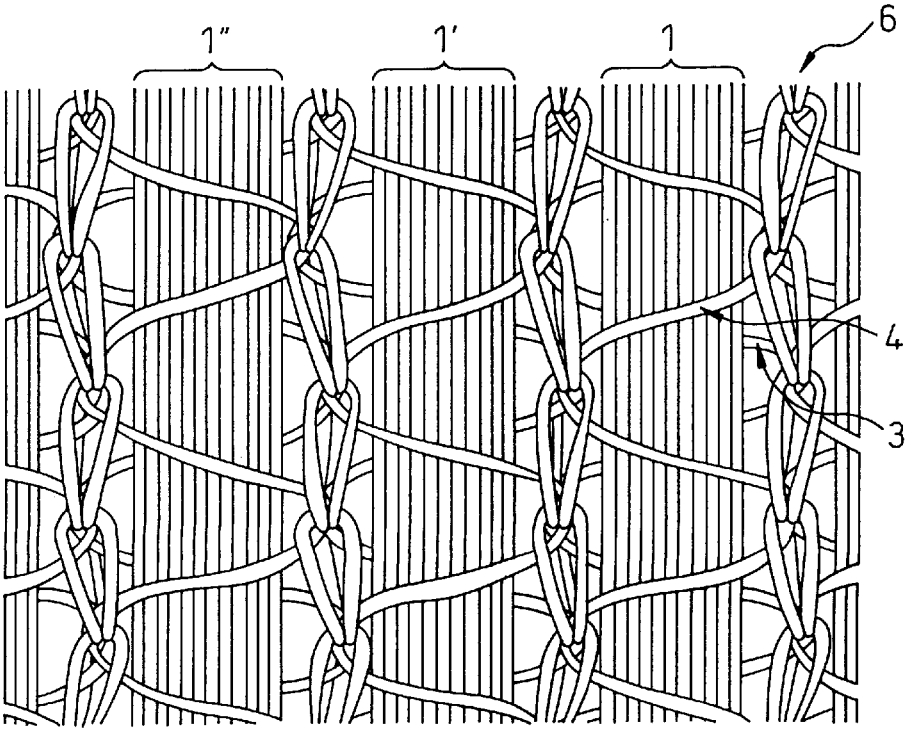

In a unidirectional fibrous sheet for structure reinforcement in FIG. 1(A), reinforcing continuous filaments are arranged to form a filament bundle (1) as a unit. Such filament bundles (1, 1', 1", - - - ) are arranged in a rib-shaped form with spacings (5, 5', 5", - - - ). On the fibrous sheet, auxiliary covering yarns (3) are arranged in such a manner that they intersect the respective rib-shaped filament bundles (1) while meandering along the longitudinal direction thereof wherein the tips of meandering exist in rib-to-rib spaces. The covering yarns (3) are each interconnected with auxiliary chain-stitching yarn (6) through rib-to-rib spaces (5) among adjacent filament bundles in a warp knitting structure. On the other hand, on the back side of the sheet, as shown in FIG. 1(B), other auxiliary covering yarns (4) which intersect the respective rib-shaped filament bundles (1) on the back side of the bundles while meandering are each interconnected with auxiliary chain-stitching yarn (6) used in common with the yarn on the front side, through rib-to-rib spaces (5) among adjacent filament bundles in a warp knitting structure used in common with the structure on the front side.

Figure 2A:
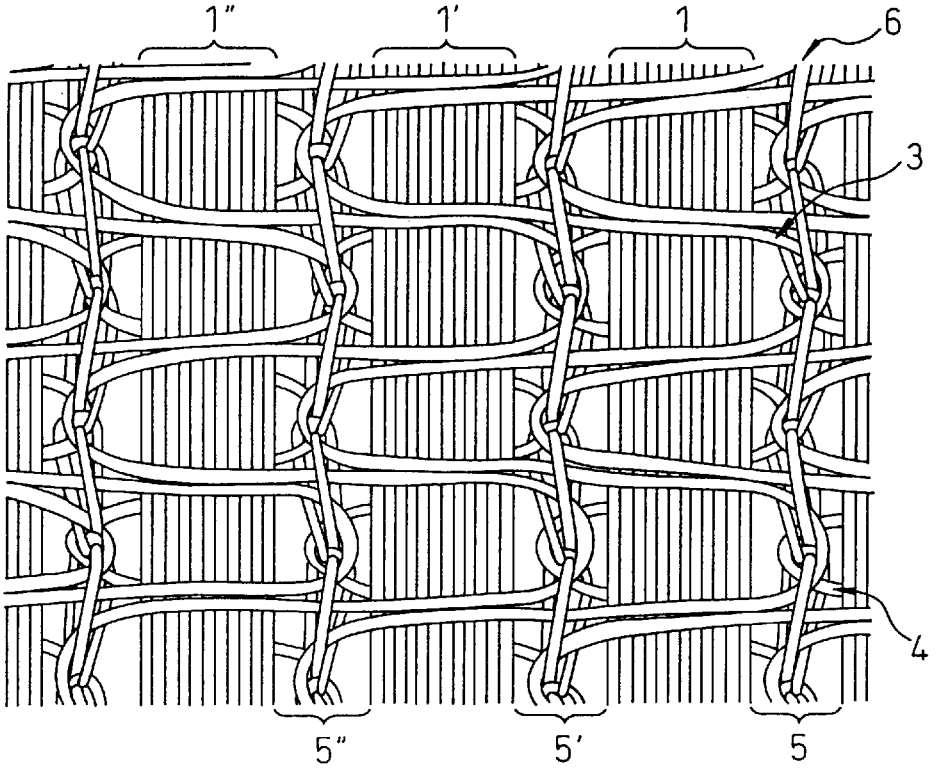
FIGS. 2(A) and 2(B) are enlarged fragmentary schematic views showing an example of a fibrous sheet for structure reinforcement of the present invention in which reinforcing continuous filaments are unidirectionally arranged.
Figure 2B:
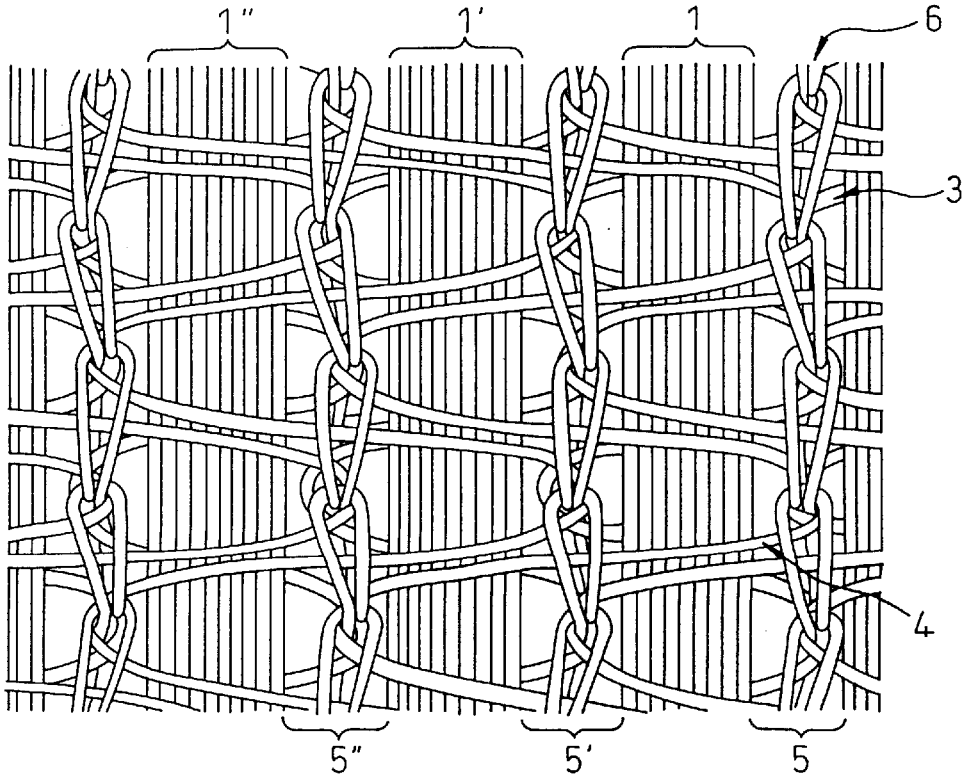

On the other hand, in a unidirectional fibrous sheet for structure reinforcement in FIGS. 2(A) and 2(B), an auxiliary covering yarn (e.g., 3 or 4) is arranged in such a manner that it intersects two adjacent rib-shaped filament bundles (e.g., 1 and 1') while meandering along the longitudinal direction of the bundles. Moreover, the covering yarn (3 or 4) is interconnected with auxiliary chain-stitching yarn (6) used in common on the front and back surfaces in a warp knitting structure through rib-to-rib spaces (5 and 5") on both sides of the two adjacent filament bundles.

That is, the fibrous sheet for structure reinforcement shown in FIGS. 1(A) and 1(B) or FIGS. 2(A) and 2(B) has a structure in which the reinforcing continuous filament bundles appear to be inserted into a meshed bag-like warp knitting structure consisting of the covering yarns (3, 4) and the chain-stitching yarn (6). The reinforcing filament bundles are prevented from forming slippages within the fibrous sheet by the meshed bag-like warp knitting structure. Moreover, since there are the rib-to-rib spaces (5) among adjacent reinforcing filament bundles, the fibrous sheet exhibits easy impregnation with resin. Furthermore, since the continuous filament bundles (1, 1', 1" - - - ) are arranged in a rib-shaped form, the strength in the arranged direction is extremely high. In particular, when the covering yarns are arranged in such a manner as shown in FIGS. 2(A) and 2(B), the fibrous sheet has advantages as described below. The reinforcing filament bundles are prevented from forming slippages within the sheet even when the chain-stitching yarn is cut. The flexural rigidity of the sheet is improved, and the easy handling of the sheet during execution of works is improved. Accordingly, the arrangement is particularly preferred.

Figure 3A:
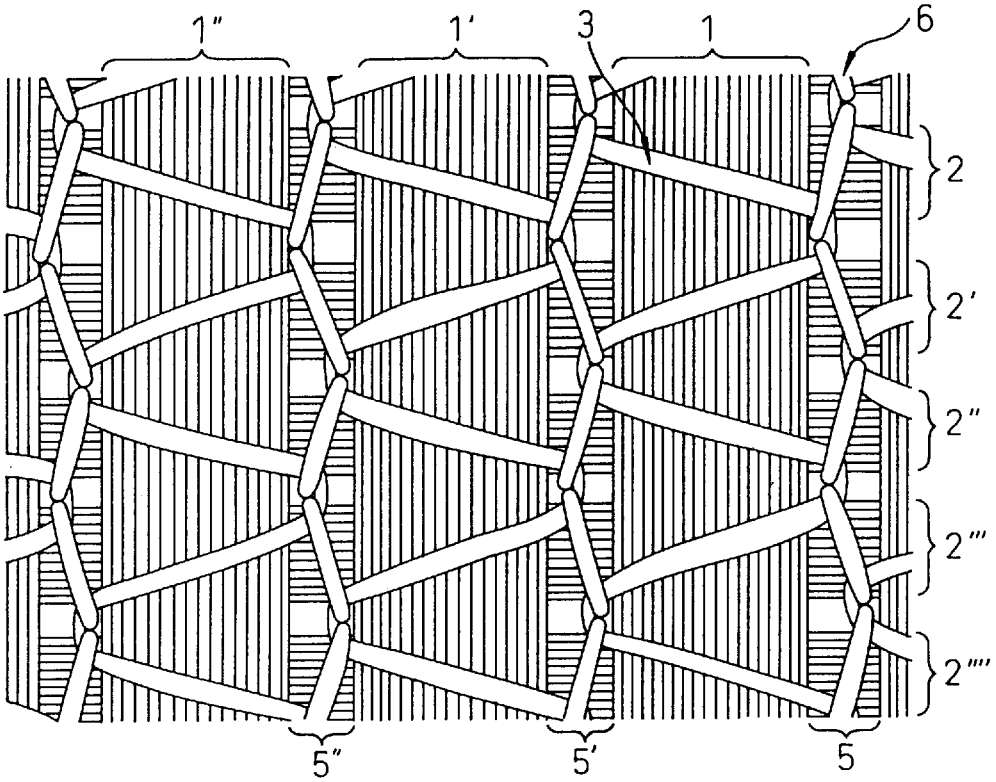
FIGS. 3(A) and 3(B) are enlarged fragmentary schematic views showing an example of a fibrous sheet for structure reinforcement of the present invention in which reinforcing continuous filaments are bidirectionally arranged.

On the front side of a bidirectional fibrous sheet for structure reinforcement shown in FIG. 3(A), reinforcing continuous filament bundles (1, 1', 1" - - - ) consisting of reinforcing continuous filaments, auxiliary covering yarns (3), auxiliary chain-stitching yarn (6) located in rib-to-rib spaces (5) of the filament bundles and a warp knitting structure with the auxiliary yarns (3, 6) are similar in the fibrous sheet in FIG. 1(A). On the other hand, on the back side of the fibrous sheet, reinforcing continuous filament bundles (2, 2', 2", 2'", 2"" - - - ) consisting of the same reinforcing continuous filaments as those forming the reinforcing continuous filament bundles (1, 1', 1" - - - ) are inserted as wefts in a rib-shaped form so that the filament bundles fulfill the role of the auxiliary covering yarns (4) in FIG. 1(B). The filament bundles inserted as wefts are interconnected with the auxiliary chain-stitching yarn (6) used in common on the front side in a warp knitting structure used in common on the front side.

Figure 3B:
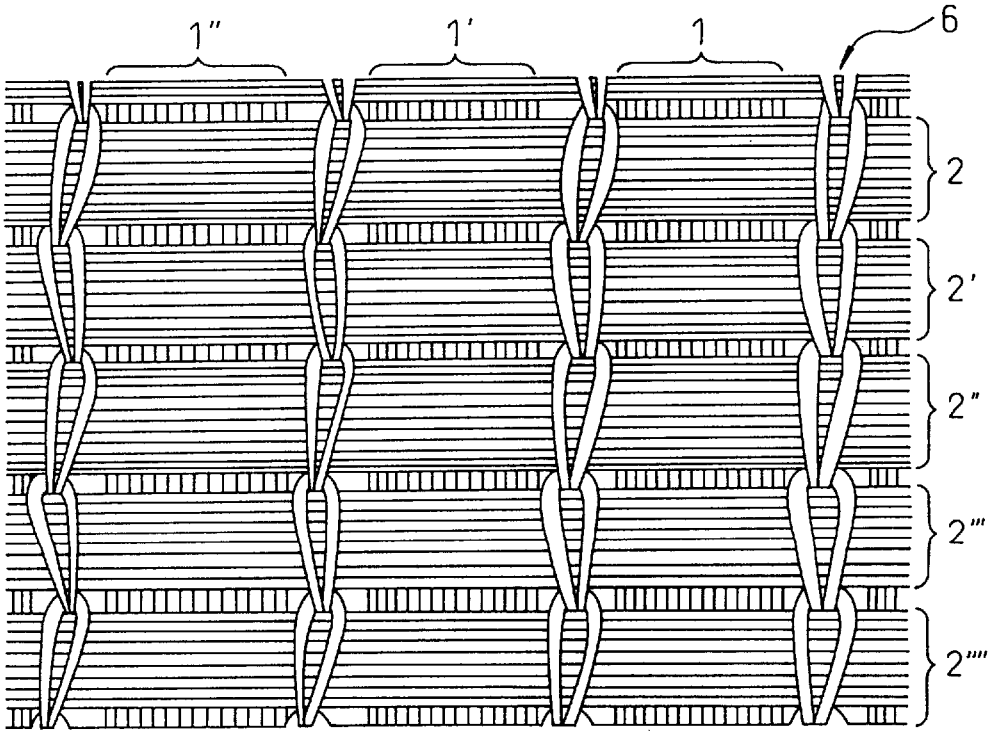

That is, the fibrous sheet for structure reinforcement shown in FIGS. 3(A) and 3(B) has a structure in which the reinforcing continuous filament bundles appear to be inserted into a warp knitting structure consisting of the auxiliary covering yarns (3) and the auxiliary chain-stitching yarn (6) by warp (1, 1', 1" - - - ) insertion and weft (2, 2', 2", 2'", 2"" - - - ) insertion. The two groups of the continuous filament bundles (1 - - - , 2 - - - ) face each other to form a bidirectional sheet surface.

Accordingly, the fibrous sheet composed of the bidirectional filament bundles is prevented from forming slippages of the filament bundles within the sheet. Moreover, since there are spaces in the filament bundles, the fibrous sheet is easily impregnated with a resin, and fully displays the strength of the reinforcing continuous filaments in the two directions.

Although the fibrous sheets for structure reinforcement in the present invention have specific warp knitting structures as mentioned above, as essential requirements, the following construction requirements for the reinforcing continuous filaments, auxiliary yarns, warp knitting structures and fibrous sheets are preferably and suitably selected.

In the filament bundles in which the reinforcing continuous filaments are arranged in parallel, the tensile strength of the reinforcing continuous filaments is preferred to be at least 20 g/de in view of the strength of the fibrous sheet for structure reinforcement. Moreover, the single filament size is preferred to be from 0.1 to 10 denier and more preferred to be from 0.1 to 2.0 denier in view of the resin impregnation into the fibrous sheet for structure reinforcement. When these requirements are satisfied, various fibers such as polyethylene fibers, carbon fibers, glass fibers and aramid fibers can be selected. Among the fibers, the aramid filaments are particularly preferred, and copoly-p-phenylene-3, 4'-oxydiphenyleneterephthalamide (trade name Technola, manufactured by Teijin Ltd.) is particularly preferred because it has not only a high strength but also a high elongation. Moreover, the size of one unit of the filament bundles is preferred to be 1,000 to 50,000 denier in view of the strength. Furthermore, the number of the filament bundles in the width direction of the fibrous sheet, namely the warp density is preferred to be from 3 to 18 bundles/inch in view of the strength and the impregnation of the resin.

Furthermore, the size and the tensile strength of the auxiliary yarns (covering yarns and chain-stitching yarn) forming the warp knitting structure which is used for preventing formation of the slippages of the reinforcing filaments are preferred to be from 50 to 3,000 denier and at least 3.0 g/de, respectively in view of the good knitting processabilities, the effects of preventing the slippage formation of the reinforcing filaments within the sheet and the prevention of the breakage of the auxiliary yarns during execution of works.

The auxiliary yarns can be suitably selected from natural fibers, semi-synthetic fibers and synthetic fibers so long as the selected fibers satisfy the requirements. Polyvinyl alcohol yarns and polyester yarns are particularly preferred.

The weft density in the warp knitting structure (namely, number of loops per inch of the auxiliary covering yarns arranged while meandering along the longitudinal direction of the reinforcing filament bundles) is preferred to be from 3 to 25 courses/inch in view of the prevention of the slippage formation of the reinforcing filaments and the impregnation of the resin.

Furthermore, the weight of the fibrous sheet containing the reinforcing filaments and the auxiliary yarns is preferred to be from 100 to 2,000 g/m$^2$ in view of the strength, easy handling and lightness.

The fibrous sheet for structure reinforcement of the present invention can be easily manufactured by modifying general raschel warp knitting. Formation of the warp knitting structure with the auxiliary covering yarns and auxiliary chain-stitching yarn is conducted in accordance with, for example, a technique published in *Knowledge of New Fibers*, Kamakura Shobo, 104–107, revised 3rd edition (1994). In addition, the fibrous sheets in FIGS. 1(A) and 1(B) and FIGS. 2(A) and 2(B) have been manufactured with a warp knitting machine with a 4-bar construction, and the fibrous sheet in FIGS. 3(A) and 3(B) has been manufactured with a warp knitting machine having a 3-bar construction by conducting weft insertion. For example, the fibrous sheet for structure reinforcement in FIGS. 1(A) and 1(B) can be easily manufactured by setting from the upper side the auxiliary chain-stitching yarns (6), the auxiliary covering yarns (3), the reinforcing filaments (1) and the auxiliary covering yarns (4) on the creels for the warp knitting machine, and supplying the filaments and yarns to a raschel warp knitting machine from the creels. Moreover, the fibrous sheet can also be prepared by stacking at least one layer in the thickness direction along the warp and/or weft. For example, the fibrous sheet in FIGS. 1(A) and 1(B) is incorporated into the fibrous sheet in FIGS. 3(A) and 3(B) to give a structure wherein the reinforcing filaments form a 3-layered sheet plane consisting of the warp directional layer, weft directional layer and warp directional layer, the auxiliary covering yarns are arranged on the first and third layers, said covering yarns thereon are interconnected with the auxiliary chain-stitching yarn in the warp knitting structure, and the reinforcing filaments in the weft direction become sandwich-like contents. The warp knitting machine has a 5-bar construction at this time, and wefts are inserted thereinto.

In the present invention, a structure member to be reinforced is covered with the fibrous sheet for structure reinforcement in the peripheral and/or longitudinal direction through an adhesive to form a reinforced structure.

A specific procedure for reinforcing a structure member to be reinforced using the fibrous sheet for structure reinforcement is as described below. For example, when a concrete column is to be reinforced, the surface of the structure member is cleaned, and peelable surface layers are removed. The structure member is coated with a primer to increase the adhesion of an adhesive. The structure member is further coated with an adhesive using a brush, a roller, a trowel, or the like. The primer and adhesive can be selected from the kinds of epoxy, urethane, ester, and the like. Moreover, the primer and the adhesive may be of the same type or different type, and they are particularly preferred to be of epoxy-based ones. Furthermore, since the temperature and humidity vary depending on the season when the reinforcement is practiced, it is needless to say that the specification (e.g. solvent, viscosity, curing agent) of the epoxy-based primer and adhesive may be changed in accordance with the season.

After coating the structure member to be reinforced with an adhesive, the fibrous sheet for structure reinforcement is laminated. The structure member is wound with the fibrous sheet on the peripheral surface while the fibrous sheet is being pulled in the horizontal direction, and the fibrous sheet thus wound is pressed with a roller, etc. to be entirely bonded. In the fibrous sheet for structure reinforcement used in the present invention, the warp knitting structure formed by the auxiliary fibers prevents the reinforcing filaments contained in the fibrous sheet from forming slippages. The fibrous sheet, therefore, is not expanded greatly even when a tensile stress is applied thereto in the horizontal direction to some degree during laminating. The fibrous sheet can, therefore, be well handled, and uniformly laminated. Moreover, since spaces are formed among reinforcing bundles, the adhesive is squeezed out of the filaments when the fibrous sheet is pressed with a roller, whereby the fibrous sheet for structure reinforcement is completely conformable to the adhesive layer.

After bonding the fibrous sheet to the entire outer periphery of the column from the upper end to the lower end is finished, an adhesive is applied to the bonded first fibrous sheet, and a second layer of the fibrous sheet is laminated. The procedure is repeated, and the fibrous sheets are bonded up to a maximum of 10 layers. Even when the fibrous sheets are laminated in an amount exceeding 10 layers, the reinforcing effects are the same as in 10 layers.

As explained above, the fibrous sheets for structure reinforcement are laminated to the structure member to be reinforced, and the outermost laminated sheet is coated with a resin mortar if necessary painted to form a surface protective layer. A sheet (a woven or knitted fabric having loops on the surface or a fibrous composite structure prepared by laminating an unwoven fabric to a mesh woven fabric) for bonding the mortar layer is preferably placed between the outermost sheet layer and the resin mortar. That is, the outermost sheet is coated with the adhesive, and the sheet for bonding the mortar layer is laminated to the outermost sheet, followed by applying the resin mortar. The resin mortar entraps the sheet for bonding the mortar layer to be integrated. The constraint force between the resin mortar and the sheet for bonding prevents crack formation in the resin mortar.

The method for reinforcing a structure member as explained above in detail is one which reinforces the structure member to be reinforced such as a concrete column by covering the structure member entirely from the upper end to the lower end in the peripheral and/or longitudinal directions. It is needless to say that the structure member may naturally be reinforced locally in the peripheral direction alone, and that the fibrous sheet for structure reinforcement may also be laminated in a flat form (namely, without winding) to a flat member such as a floor system and a wall in accordance with the shape.

In reinforcing a structure member to be reinforced using the fibrous sheet for structure reinforcement of the present invention, the reinforcing continuous filaments of the fibrous sheet, having a high strength and a high elastic modulus are naturally optimum. Carbon fibers surely satisfy the requirements from such a standpoint. However, several problems are pointed out in reinforcing a column composed of, for example, concrete, using the carbon fiber sheet. One of the problems is that since the carbon fibers have a low elongation and are less elongated, reinforcing an acute portion of the structure member must be conducted after chamfering the portion so that it has an obtuse angle or a smooth shape.

On the other hand, since aramid (aromatic polyamide) fibers have a high strength and a high elastic modulus and are elongated more than the carbon fibers, the chamfering operation is not necessary, and the aramid fibers have come to be adopted for reinforcement recently from the standpoint of improving the workability. However, it has heretofore been pointed out that the aramid fibers have a poor weatherability compared with other fibers. In reinforcing a column composed of, for example, concrete using an aramid fibrous sheet, the durability of reinforcement with the aramid fibrous sheet is feared when cracks are formed in the finishing layer (mortar or paint) after reinforcement. Concerning the reinforcement by covering with an aramid fibrous sheet, it is, therefore, preferred that at least the outermost layer of the covered fibrous sheets for structure reinforcement be impregnated with an adhesive containing a UV stabilizer and bonded with the adhesive. The UV stabilizer herein refers to an agent added for the purpose of protecting the aramid fibers forming the aramid fibrous sheet from being deteriorated as a result of absorbing UV rays (wavelength: 380 nm). The UV stabilizer is, for example, a general UV absorbing agent such as carbon and titanium dioxide. The UV stabilizer is added to the adhesive in an amount of 0.75 to 5.0% by weight, preferably 0.75 to 2.0% by weight. Moreover, the adhesive layer containing the UV stabilizer is formed on the fibrous sheet for structure reinforcement to have a thickness of 150 to 700 mμ, preferably 200 to 700 mμ. When the amount of the UV absorber is less than 0.75% by weight, or the thickness of the adhesive layer is less than 150 mμ, significant effects of weathering resistance cannot be obtained. When the amount of the UV absorber exceeds 5.0% by weight, or the thickness of the adhesive layer exceeds 700 mμ, the effects are the same as in 5.0% by weight or 700 mμ layer.

Industrial Applicability

Since reinforcing continuous filaments having a high strength in the fibrous sheet for structure reinforcement of the present invention are arranged with spaces within the sheet by specific warp knitting structure with auxiliary yarns, the following advantages are obtained: there are no slippages of the reinforcing continuous filaments within the sheet, the sheet shows good impregnation of the resin owing to the presence of spaces among the filaments, and the sheet shows a sufficient strength in the arranged direction of the filaments. Accordingly, by being impregnated with a resin, the sheet is useful for reinforcing not only general structures but also piers and floor systems of elevated structures, columns and walls of buildings, and the like. Moreover the sheet is excellent in easy handling and lightness during execution of works, and since a reinforced structure has a high tensile strength and a high shear strength, it has, therefore, an extremely high industrial value as a reinforced structure compared with other materials.

The present invention will be further illustrated with reference to the following examples. However, the scope of the present invention is by no means restricted by these examples.

In addition, the properties of the sheets in the examples are evaluated on the basis of the criteria mentioned below. Knitting processability The knitting processability is evaluated from the number of stops of the knitting machine, per 100 m during forming the fibrous sheet in a warp knitting structure and the results are shown by the following criteria:

| | |
|---|---|
| less than 5 times | ◎ |
| from 5 to 10 times | ○ |
| from 10 to 30 times | Δ |
| at least 30 times | x |

Appearance quality of sheets The appearance quality of a sheet is evaluated from number of defects (slippages, fluffs, broken threads) per 25 $m^2$ of the fibrous sheet and the results are shown by the following criteria:

| | |
|---|---|
| less than 10 | ◎ |
| from 10 to 20 | ○ |
| from 20 to 40 | Δ |
| at least 40 | x |

Impregnation of resin: Using an adhesive (article No. A20, trade name of AR Bond, manufactured by Teijin Ltd.), the epoxy resin and the curing agent are mixed in a ratio of 2:1. A concrete is coated with the adhesive and a sheet is bonded to the concrete by the adhesive thus obtained so that the adhesion force between them becomes 30 $kgf/cm^2$ (in accordance with JIS A6916). The impregnation is evaluated from the amount of the adhesive for the adhesion force between them becoming 30 $kgf/cm^2$, and the evaluation criteria are as follows:

| | | |
|---|---|---|
| the amount of adhesive | small | ◎ |
| | medium | ○ |
| | large | Δ |
| | very large | x |

EXAMPLES 1 to 10

Among copoly-p-phenylene-3,4'-oxydiphenyleneterephthalamide fibers (trade name

Technola, manufactured by Teijin Ltd.), continuous filaments having a single filament denier of 1.5 denier, a strength of 28 g/de and sizes as shown in Table 1 were used as reinforcing continuous filaments. Moreover, among groups of polyethyeleneterephthalate fibers (trade name Tetron, manufactured by Teijin Ltd.), those groups having a strength of 5.0 g/de and sizes shown in Table 1 were used as auxiliary covering yarns and auxiliary chain-stitching yarn. The chain-stitching yarn, covering yarns, reinforcing filaments and covering yarns were set on the creels in this order from the upper side, and supplied to a raschel warp knitting machine (4 bar construction, chain-stitched structure). The warp density of the reinforcing filament bundles and the weight of the fibrous sheet were varied during the preparation as shown in Table 1 to obtain fibrous sheets for structure reinforcement. The fibrous sheets thus obtained had a structure as shown in FIGS. 1(A) and 1(B), and the reinforcing continuous filaments were unidirectionally arranged to form a single layer alone. Table 1 shows the evaluation results of the knitting processabilities of the fibrous sheets, the appearance quality of the sheets such as slippages and impregnation of the epoxy resin.

EXAMPLES 11 to 16

The characteristics (size and density) of the filament bundles composed of reinforcing filaments or the weft density of the warp knitting in Example 3 were changed as shown in Table 2 to obtain fibrous sheets for structure reinforcement. The fibrous sheets were evaluated in the same manner as in Example 3, and the results thus obtained are listed in Table 2.

EXAMPLES 17 to 19

Auxiliary chain-stitching yarn, auxiliary covering yarns and reinforcing filaments (both of yarns and filaments same as in example 3) were set on the creels in this order from the upper side, and supplied to a raschel warp knitting machine (3 bar construction). At this time, continuous filament bundles composed of the above reinforcing continuous filaments and having a size of 4,500 de were weft-inserted as auxiliary covering yarns on the back side. The fibrous sheet thus obtained had a structure as shown in FIGS. 3(A) and 3(B). Table 2 also shows the evaluation results of the fibrous sheets as a function of the density of the filament bundles and the weft density of the warp knitting structure.

TABLE 1

| | | | Ex. 1 | Ex. 2 | Ex. 3 | Ex. 4 | Ex. 5 |
|---|---|---|---|---|---|---|---|
| Reinforcing filaments | Size of filament bundles | de | 800 | 1200 | 7500 | 45000 | 52000 |
| | Warp density of filament bundles | bundles/inch | 18 | 18 | 9 | 9 | 9 |
| Auxiliary yarns | Size | de | 200 | 200 | 200 | 200 | 200 |
| Structure | Weft density | courses/inch | 15 | 15 | 15 | 15 | 15 |
| | Weight | $g/m^2$ | 98 | 130 | 330 | 1800 | 2100 |
| Sheet properties | Warp strength of sheet | ton/10 cm | 1.4 | 2.1 | 6.6 | 39 | 46 |
| | Warp elongation of sheet | % | 5 | 5 | 5 | 5 | 5 |
| | Knitting processability | ◎ ○ Δ x | ◎ | ◎ | ◎ | ○ | ○ |
| | Appearance qulaity of sheet | ◎ ○ Δ x | ◎ | ◎ | ◎ | ○ | ○ |
| | Impregnation of resin | ◎ ○ Δ x | ◎ | ◎ | ◎ | ○ | Δ |

| | | | Ex. 6 | Ex. 7 | Ex. 8 | Ex. 9 | Ex. 10 |
|---|---|---|---|---|---|---|---|
| Reinforcing filaments | Size of filament bundles | de | 7500 | 7500 | 7500 | 7500 | 7500 |
| | Warp density of filament bundles | bundles/inch | 9 | 9 | 9 | 9 | 9 |
| Auxiliary yarns | Size | de | 40 | 60 | 200 | 800 | 1200 |
| Structure | Weft density | courses/inch | 15 | 15 | 15 | 15 | 15 |
| | Weight | g/m2 | 300 | 306 | 330 | 435 | 506 |
| Sheet properties | Warp strength of sheet | ton/10 cm | 6.1 | 6.5 | 6.6 | 6.6 | 6.6 |
| | Warp elongation of sheet | % | 5 | 5 | 5 | 5 | 5 |
| | Knitting processabiiity | ◎ ○ Δ x | ○ | ○ | ◎ | ◎ | ◎ |
| | Appearance quality of sheet | ◎ ○ Δ x | Δ | ○ | ◎ | ◎ | ○ |
| | Impregnation of resin | ◎ ○ Δ x | ◎ | ◎ | ◎ | ○ | Δ |

TABLE 2

| | | | Ex. 11 | Ex. 12 | Ex. 13 | Ex. 14 | Ex. 15 |
|---|---|---|---|---|---|---|---|
| Reinforcing filament | Size of filament bundles | de | 30000 | 4500 | 4500 | 7500 | 7500 |
| | Warp density of filament bundles | bundles/inch | 2 | 18 | 20 | 9 | 9 |
| Auxiliary yarns | Size | de | 200 | 200 | 200 | 200 | 200 |
| Structure | Weft density | courses/inch | 15 | 15 | 15 | 2 | 23 |
| | Weight | g/m | 290 | 404 | 410 | 308 | 358 |
| Sheet properties | Warp strength of sheet | ton/10 cm | 5.4 | 7.9 | 8.7 | 5.9 | 6.6 |
| | Warp elongation of sheet | % | 5 | 5 | 5 | 5 | 5 |
| | Weft strength of sheet | ton/10 cm | — | — | — | — | — |
| | Weft elongation of sheet | % | — | — | — | — | — |
| | Knitting processability | ◎ ○ Δ x | Δ | ○ | Δ | Δ | ◎ |
| | Appearance quality of sheet | ◎ ○ Δ x | Δ | ○ | Δ | Δ | ◎ |
| | Impregnation of resin | ◎ ○ Δ x | ○ | ○ | Δ | ○ | ○ |

| | | | Ex. 16 | Ex. 17 | Ex. 18 | Ex. 19 |
|---|---|---|---|---|---|---|
| Reinforcing filaments | Size of filament bundles | de | 7500 | 7500 | 7500 | 7500 |
| | Warp density of filament bundles | bundles/inch | 9 | 6 | 9 | 15 |
| Auxiliary yarns | Size | de | 200 | 200 | 200 | 200 |
| Structure | Weft density | courses/inch | 27 | 10 | 15 | 25 |
| | Weight | $g/m^2$ | 363 | 430 | 625 | 1055 |
| Sheet properties | Warp strength of sheet | ton/10 cm | 6.6 | 4.4 | 6.6 | 11 |
| | Warp elongation of sheet | % | 5 | 5 | 5 | 5 |
| | Weft strength of sheet | ton/10 cm | — | 4.4 | 6.6 | 11 |
| | Weft elongation of sheet | % | — | 5 | 5 | 5 |
| | Knitting processability | ◎ ○ Δ x | ○ | ◎ | ◎ | ◎ |
| | Appearance quality of sheet | ◎ ○ Δ x | ○ | ◎ | ◎ | ○ |
| | Impregnation of resin | ◎ ○ Δ x | Δ | ◎ | ◎ | ○ |

From the evaluation results in Examples 1 to 19, conclusions as described below can be drawn. To comprehensively satisfy the knitting processability, appearance quality and impregnation of the fibrous sheet for structure reinforcement of the present invention, it is preferred that the following conditions be satisfied: the size o f the filament bundles of the reinforcing continuous filaments is from 1,000 to 50,000 denier, the warp density thereof is from 3 to 18 bundles/inch, the size of the auxiliary yarns is from 50 to 1,000 denier, the weft density of the warp knitting structure is from 3 to 25 courses/inch, and the weight of the fibrous sheet is from 100 to 2,000 $g/M^2$.

EXAMPLES 20 to 21

A reinforced concrete member having a square section (side length: 90 cm) and a length of 3 m was wound with the aramid fibrous sheet for structure reinforcement having sheet properties in Example 3 three times over the entire periphery from the upper end to the lower end, through an epoxy adhesive (article No. A20, trade name of AR Bond, manufactured by Teijin Ltd., ratio of epoxy curing agent= 2:1) to be covered and reinforced. During the winding operation, the outermost layer was coated with the epoxy adhesive in which 1.0% of a UV stabilizer (weight ratio of titanium dioxide/carbon of 100:3) had been added, and the resin thickness was 350 μm (Example 20). Alternatively, the outermost layer was coated with the epoxy resin containing no UV stabilizer, and the resin thickness was 700 μm (Example 21). The covered reinforced concrete members having no surface protective layer (resin mortar) were allowed to stand outdoors for 1 year. The concrete member prepared in Example 20 showed no substantial appearance change, whereas the one prepared in Example 21 showed discoloration of the resin layer and was somewhat embrittled.

We claim:

1. A fibrous sheet for structure reinforcement comprising a sheet layer of reinforcing continuous filament bundles arranged parallelly spaced out from each other; said reinforcing continuous filaments having a tensile strength of at least 20 g/de, auxiliary covering yarns arranged on both sides of said sheet layer in such a manner that each of said covering yarns intersects respective reinforcing filament bundles while meandering along the longitudinal direction of said reinforcing filament bundles on at least one side of said sheet layer, and auxiliary chain-stitching yarns which interconnect the auxiliary covering yarns on one side of said sheet layer with the auxiliary covering yarns on the other side of said sheet layer through individual spaces among adjacent reinforcing filament bundles in a warp knitting structure.

2. The fibrous sheet for structure reinforcement according to claim 1, wherein either one of said auxiliary covering yarns is reinforcing continuous filament bundles of the same reinforcing continuous filaments as those forming said reinforcing continuous bundles and inserted as wefts in the warp knitting structure.

3. The fibrous sheet for structure reinforcement according to claim 1 or 2, wherein the warp density of said bundles is from 3 to 18 bundles/inch.

4. The fibrous sheet for structure reinforcement according to any one of claims 1 or 2, wherein the weft density of the warp knitting structure is from 3 to 25 courses/inch.

5. The fibrous sheet for structure reinforcement according to any one of claims 1 oe 2, wherein the size of said auxiliary yarns is from 50 to 3,000 denier.

6. The fibrous sheet for structure reinforcement according to claim 5, wherein the tensile strength of said auxiliary yarns is at least 3.0 g/de.

7. The fibrous sheet for structure reinforcement according to any one of claims 1 or 2, wherein the size of said bundles is from 1,000 to 50,000 denier.

8. The fibrous sheet for structure reinforcement according to any one of claims 1 or 2, wherein the single filament size of said reinforcing continuous filaments is from 0.1 to 10 denier.

9. The fibrous sheet for structure reinforcement according to any one of claims 1 or 2, wherein the reinforcing continuous filaments are aramid filaments.

10. The fibrous sheet for structure reinforcement according to claim 9, wherein the reinforcing continuous filaments are aramid filaments composed of copoly-p-phenylene-3,4'-oxydiphenyleneterephthalamide.

11. The fibrous sheet for structure reinforcement according to any one of claims 1 or 2, wherein the weight of the fibrous sheet is from 100 to 2,000 g/m$^2$.

12. A structure formed by covering a structure member to be reinforced with the fibrous sheet for structure reinforcement according to any one of claims 1 or 2 in the periphery and/or longitudinal direction through an adhesive.

13. The structure according to claim 12, wherein the structure is formed by winding the structure member to be reinforced with the fibrous sheet for structure reinforcement in at least the periphery 1 to 10 times through an adhesive.

14. The structure according to claim 12, wherein the structure is formed by covering the structure member to be reinforced with the fibrous sheet for structure reinforcement in the longitudinal direction 1 to 10 times through an adhesive without winding.

* * * * *